United States Patent [19]

Kobayashi et al.

[11] Patent Number: 4,546,747

[45] Date of Patent: Oct. 15, 1985

[54] LEAN MIXTURE CONTROL SYSTEM USING A BIASED OXYGEN CONCENTRATION SENSOR

[75] Inventors: Akio Kobayashi, Kariya; Susumu Harada, Okazaki; Takashi Harada, Hekinan; Takehiro Kikuchi, Oobu; Masakazu Honda, Anjo, all of Japan

[73] Assignee: Nippondenso Co., Ltd., Kariya, Japan

[21] Appl. No.: 617,476

[22] Filed: Jun. 5, 1984

[30] Foreign Application Priority Data

Jun. 7, 1983 [JP] Japan ..... 58-102113

[51] Int. Cl.[4] ..... F02M 7/00; F02B 3/00

[52] U.S. Cl. ..... 123/489; 123/440

[58] Field of Search ..... 123/489, 440

[56] References Cited

U.S. PATENT DOCUMENTS

| | | | |
|---|---|---|---|
| 4,380,986 | 4/1983 | Latsob et al. | 123/440 |
| 4,430,976 | 2/1984 | Kondo et al. | 123/440 |
| 4,445,481 | 5/1984 | Aoki et al. | 123/489 |
| 4,454,852 | 6/1984 | Hasegawa | 123/489 |
| 4,461,258 | 7/1984 | Becker et al. | 123/489 |
| 4,466,410 | 8/1984 | Sakakibara et al. | 123/440 |
| 4,467,769 | 8/1984 | Matsumura | 123/489 |
| 4,475,517 | 10/1984 | Kobayashi et al. | 123/489 |
| 4,478,193 | 10/1984 | Watanabe | 123/489 |
| 4,502,444 | 3/1985 | Rubbo et al. | 123/440 |

*Primary Examiner*—Raymond A. Nelli

*Attorney, Agent, or Firm*—Cushman, Darby & Cushman

[57] ABSTRACT

A mixture control system comprises an oxygen sensor for generating a sensor signal varying linearly as a function of the oxygen concentration of exhaust emissions from an internal combustion engine when the air-fuel ratio of mixture supplied thereto is leaner than stoichiometric value. Optimum values of the sensor signal are stored in storage locations of a memory addressable as a function of detected engine operating parameters. A data processor determines the quantity of fuel to be supplied to the engine in accordance with the detected engine operating parameters, addresses the memory as a function of the detected engine operating parameters, detects a difference between the sensor signal and a signal addressed in the memory, integrates the difference and corrects the fuel quantity with the integrated value.

10 Claims, 19 Drawing Figures

LEAN MIXTURE CONTROL SYSTEM USING A BIASED OXYGEN CONCENTRATION SENSOR

BACKGROUND OF THE INVENTION

The present invention relates to a feedback control system for internal combustion engines in accordance with the oxygen concentration of the exhaust emissions to maintain the air-fuel ratio of the mixture supplied to the engine at a desired point.

An oxygen sensor of the type wherein the sensor is biased to generate a linearly varying saturation current is shown and described in Japanese Laid-open Patent Applications Nos. 57-192852 and 57-192854. This type of oxygen sensor is advantageous in that it enables detection of the oxygen concentration of exhaust emissions from an internal combustion engine as a linear indication of the air-fuel ratio of the mixture supplied thereto when it is leaner than stoichiometric. A mixture control system employing the biased oxygen sensor is disclosed in Japanese Laid-open Patent Application No. 58-20950.

SUMMARY OF THE INVENTION

A primary object of the present invention is to provide a mixture control system which ensures precision mixture ratio control over a wide range of engine operating parameters on the leaner side of stoichiometric and quick response lean mixture control to varying engine operating conditions.

According to the present invention, the mixture control system comprises an oxygen sensor for generating a sensor signal varying linearly as a function of the oxygen concentration of exhaust emissions from an internal combustion engine when the air-fuel ratio of mixture supplied thereto is leaner than stoichiometric value. Optimum values of the sensor signal are stored in storage locations of a memory addressable as a function of detected engine operating parameters. A data processor determines the quantity of fuel to be supplied to the engine in accordance with the detected engine operating parameters, addresses the memory as a function of the detected engine operating parameters, detects a difference between the sensor signal and a signal addressed in the memory, integrates the difference and corrects the fuel quantity with the integrated value.

According to a feature of the invention, the aging effect of the oxygen sensor is compensated in accordance with a deviation of a sensor signal generated during a steady engine operating condition from a signal addressed in the memory during the steady condition.

According to a further feature of the invention, the aging effect is compensated in accordance with a deviation of a first sensor signal generated in a first steady engine operating condition from a second sensor signal generated in a second steady engine operating condition.

BRIEF DESCRIPTION OF THE DRAWINGS

The present invention will be described in further detail with reference to the accompanying drawings, in which.

DETAILED DESCRIPTION

Figure 1:
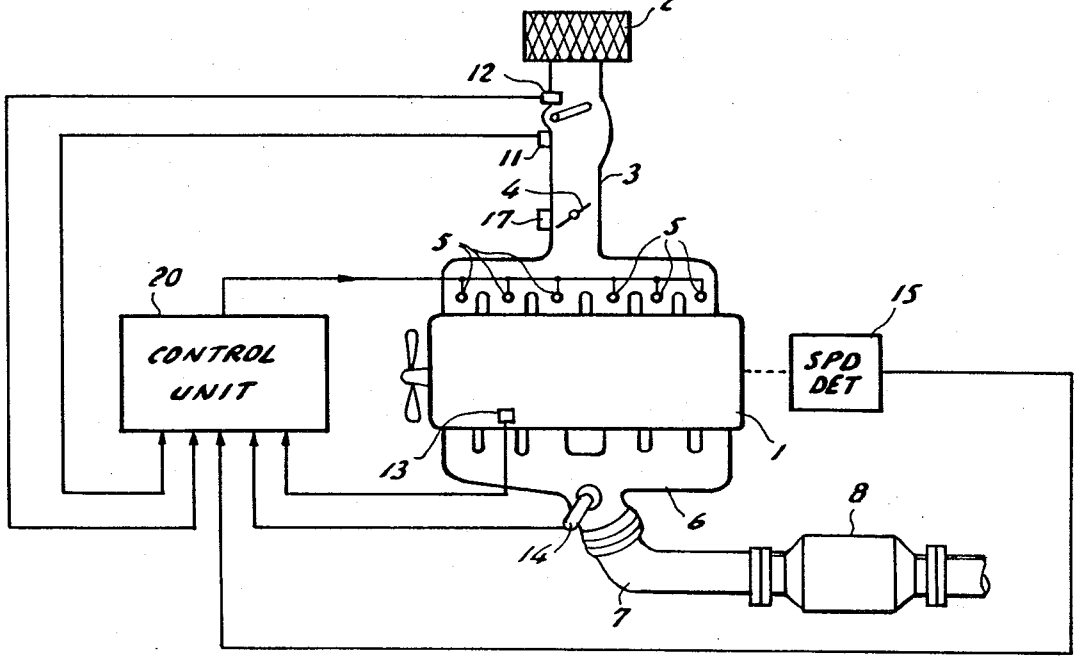
FIG. 1 is a schematic block diagram of a mixture control system shown in conjunction with an internal combustion engine.

In FIG. 1, a four-cycle spark ignition internal combustion engine 1 is supplied with a mixture of air and fuel, the air being fed through an air cleaner 2 and an intake manifold 3 and via a throttle valve 4. The fuel is supplied from a well known fuel delivery system, not shown, and injected to indiviual cylinders by electronically controlled fuel injection valves 5. The emissions are exhausted through an exhaust manifold 6, exhaust pipe 7 and through a three-way catalytic converter 8 to the outside. An airflow sensor 11 is provided on the intake manifold 3 to detect the amount of air inducted therethrough and generate therefrom a corresponding analog signal. A thermistor air temperature sensor 12 detects the temperature of the inducted air and generates a corresponding analog temperature signal. A thermistor coolant temperature sensor 13 detects the engine coolant temperature and generates a corresponding analog signal.

Figure 3:
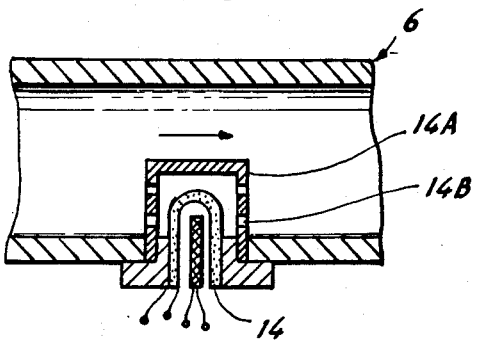
FIGS. 3 to 6 are illustrations of an oxygen sensor and the operating characteristics thereof.
Figure 4:
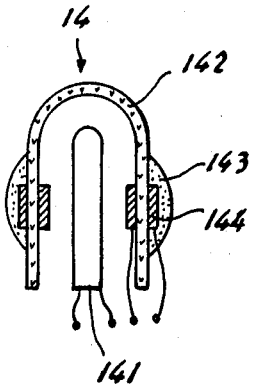

An oxygen concentration sensor 14 is provided in the exhaust manifold 6. This sensor is mounted in a perforated cover 14A (FIG. 3) on the inner wall of the exhaust pipe 6 and includes a heater 141 (FIG. 4) within a zirconia cup-shaped member 142 which is provided with opposed electrodes 144 one of which is coated with a porous material 143. With the application of a DC potential of 0.8 volts, the sensor 14 exhibits a constant current characteristic as a function of the oxygen content of exhaust emissions.

An engine speed sensor 15 detects the crankshaft revolution of the engine 1 and generates a pulse signal with a frequency proportional to the speed of crankshaft rotation. The ignition pulse that is obtained from the primary winding of an ignition coil may be used as such an engine speed pulse signal. A throttle open switch 17 is operatively coupled to the throttle valve 4 to generate a throttle-open signal.

A fuel injection control unit 20 is a data processor which performs logical operations upon input signals supplied from the various sensors 11 to 15 mentioned above to determine the optimum fuel quantity to open the injection valves 5.

Figure 2:
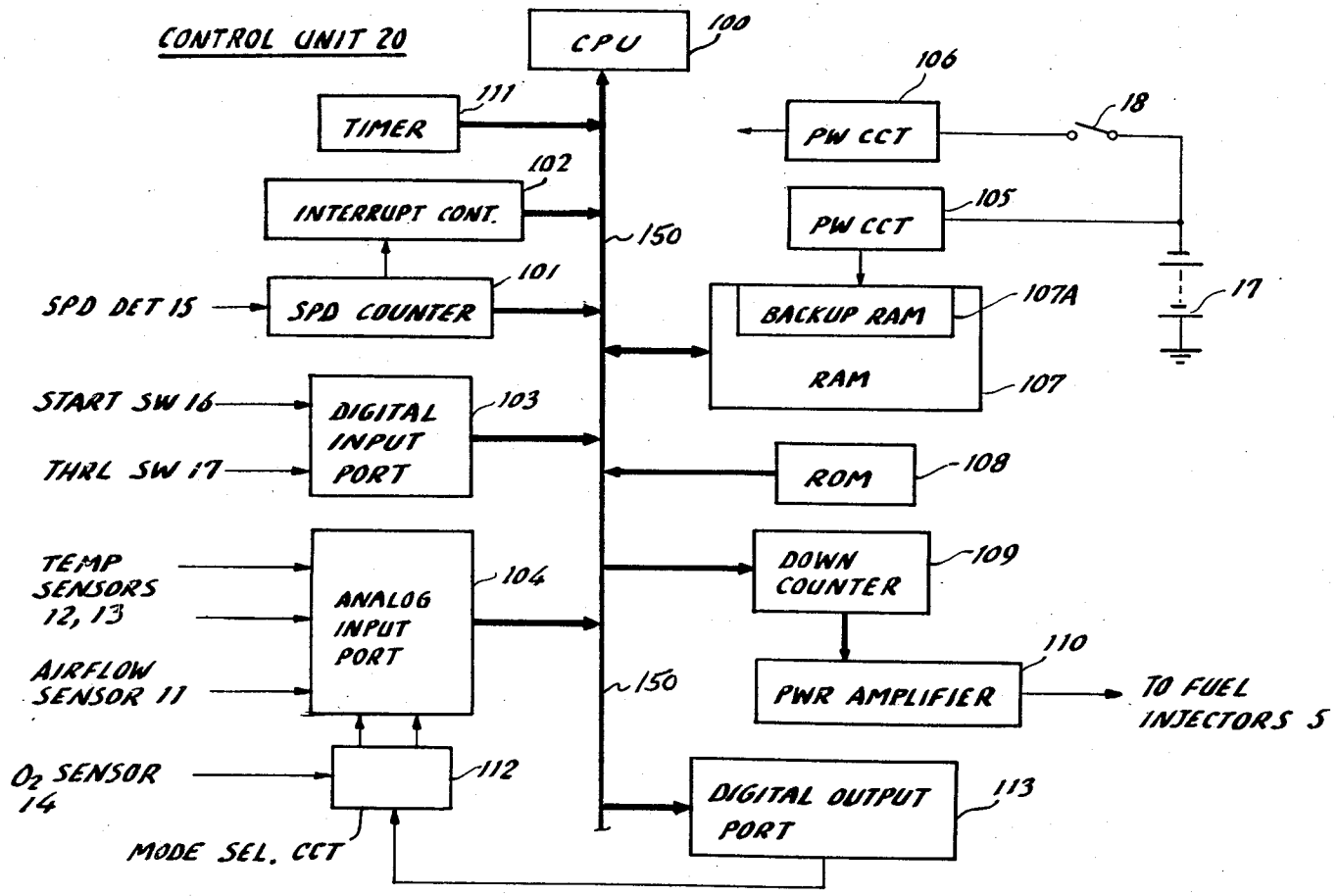
FIG. 2 is a block diagram illustrating the detail of the control unit of FIG. 1 with associated sensors.

Details of the fuel injection control unit 20 are shown in FIG. 2. An engine speed counter 101 receives an output from the engine speed detector 15 and provides a digital signal indicating the engine speed to the CPU 100 via bus 150 and an interrupt command in synchronism with each crankshaft rotation to an interrupt control unit 102 which in turn notifies the CPU 100 of the occurrence of a demand to interrupt the main routine which it has been executing according to instructions given by ROM 108. A digital input port 103 receives a signal from an engine starter 16 and the throttle open signal from the throttle sensor 17 and feeds digital signals to the CPU. An analog input port 104 comprises an analog multiplexer that sequentially multiplexes the signals from sensors 11 to 13 and the signal from oxygen sensor 14 via an interface 104 the detail of which will be described hereinbelow. The multiplexed signals are sequentially digitized by an analog-to-digital converter and fed to the CPU 100.

The random access memory 107 includes a backup RAM 107A which is powered from a power circuit 105 which is directly coupled to a battery 17, while other units of the data processor are powered from a circuit 106 which is coupled to the battery via a key switch 18.

A programmable down-counter 109 is connected to the bus 150 to receive fuel injection command signal to its preset input and count down the preset value in response to clock pulses until the preset value is reduced to zero, generating a pulse which is amplified by a power stage 110 and fed to the fuel injection valves 5. Further included is a timer 111 that measures the lapse of time for providing timing in action required by the CPU.

In a preferred embodiment of the present invention, mixture ratio control mode is switched between lean control mode and stoichiometric control mode. This occurs automatically to compensate for errors arising from the aging of oxygen sensor 14. For this purposes, a mode select circuit 112 is connected to the oxygen sensor 14.

Figure 5:
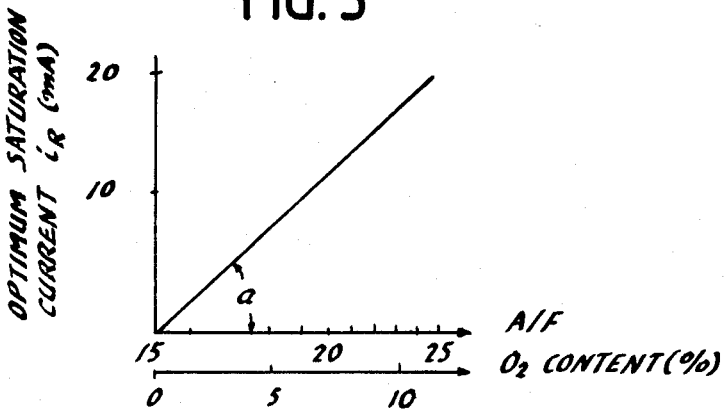
Figure 7:
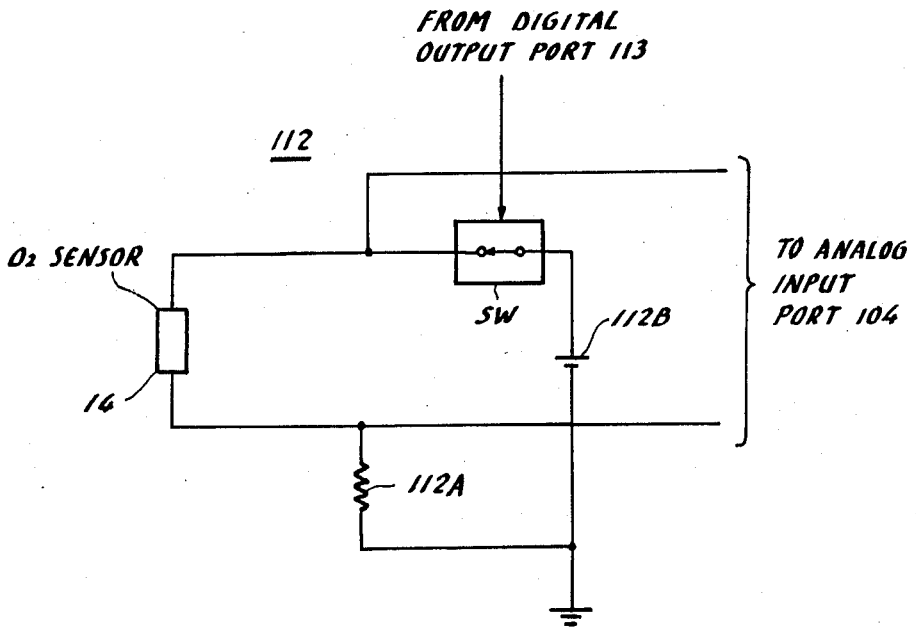
FIG. 7 is a circuit diagram of a mode select circuit associated with the oxygen sensor.

FIG. 7 illustrates the detail of the mode select circuit 112. The oxygen sensor 14 is positively biased to 0.7 or 0.8 volts by a DC voltage source 112B through a saturation-current detecting resistor 112A and a mode select switch SW when the latter is switched to the lean control position in response to a lean control command signal supplied from a digital output port 113. The voltage developed across the resistor 112A represents the saturation current which varies linearly as a function of oxygen concentration as shown in FIG. 5.

Figure 6:
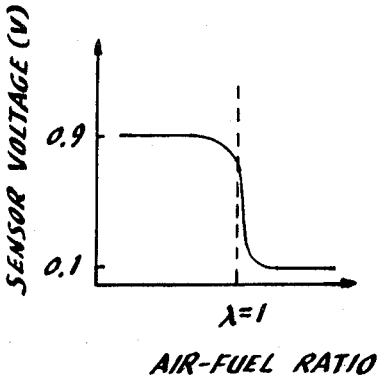

The mode select switch SW is switched to the stoichiometric control position in response to a stoichiometric command signal from the digital port 113 to remove the positive bias from the oxygen sensor 14 to utilize its output voltage which varies sharply at stoichiometry (FIG. 6).

As will be described later, the mixture ratio is controlled linearly to an optimum lean mixture ratio in accordance with the registered saturation current when the switch SW is in the lean control position and when the latter is switched to the stoichiometric control position, the mixture ratio is controlled to the stoichiometric point.

Figure 8:
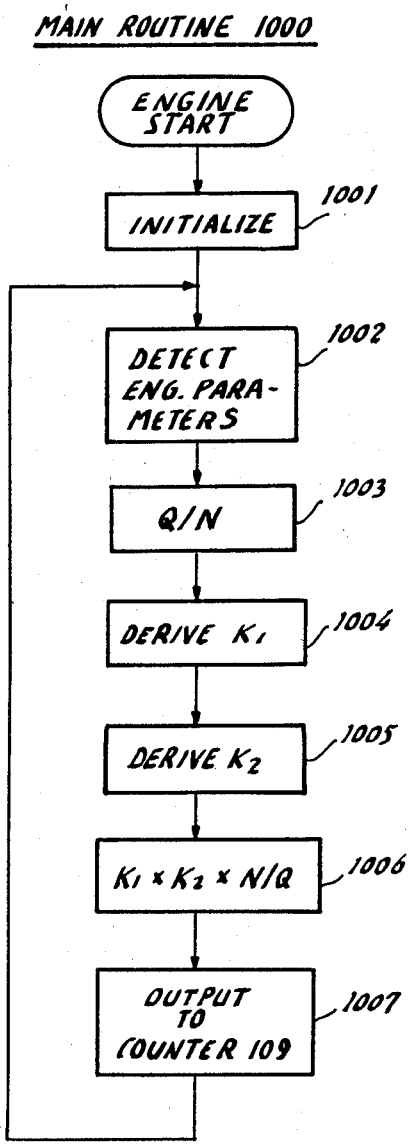
FIGS. 8 and 9 are flow diagrams according to a first embodiment of the present invention.

FIG. 8 is an illustration of a flow diagram associated with the main routine of the data processor 20. With the ignition key switch 18 and engine starter switch 16 being turned on (block 1000), the microcomputer is initialized (block 1001). Various input parameters including engine speed N, airflow rate Q, oxygen sensor output $O_2$, and air and coolant temperatures T are read into the RAM (block 1002). The microprocessor 100 performs operations on the parameters Q and N to derive a basic fuel quantity (block 1003). This is derived by dividing Q by N and multiplying a constant Ko, or by addressing a lookup table as a function of these parameters to find the corresponding value. Other parameters such as intake air pressure and engine speed value may be employed to derive the basic fuel quantity. A trimming value $K_1$ is derived in block 1004 as a function of coolant and air temperature data and engine starter output, the derived $K_1$ value being stored in RAM 107. Engine acceleration parameter may also be taken into account to derive the trimming value $K_1$.

A second trimming value $K_2$ is derived from the oxygen sensor output $O_2$ (block 1005). The trimming value $K_2$ represents the deviation of the actual saturation current from an optimum value which is derived from a stored lookup table or map. In block 1006, $K_1 \times K_2 \times N/Q$ is computed to derive an optimum fuel quantity value which is delivered to down-counter 109 (block 1007) to cause fuel injectors to inject fuel according to the optimum value at a predetermined crankshaft angle. Control then returns to block 1002 to repeat the above steps.

Figure 9:
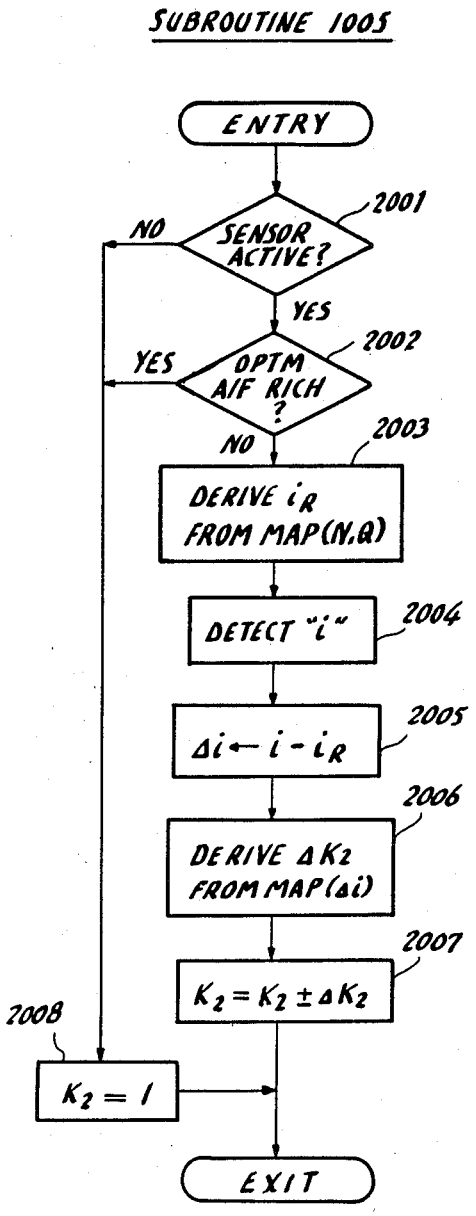
Figure 10:
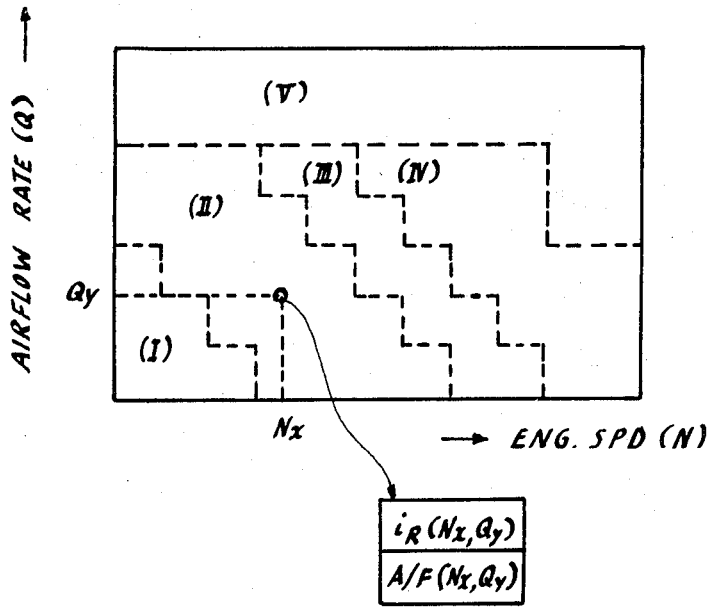
FIG. 10 is an illustration of lookup table or map within the random access memory of FIG. 2 in which optimum values of saturation current are stored in matrix locations addressable as a function of engine speed and airflow rate.
Figure 11:
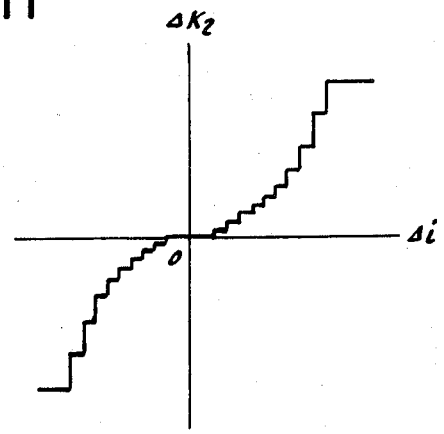
FIG. 11 is a graphic illustration of the relationship between an integral trimming value and a deviation saturation current.

Details of the operation of block 1005 are given in FIG. 9. The operating state of the oxygen sensor 14 is checked in block 2001. In one example, the operating temperature of this sensor is checked against a critical value (typically 500 to 600 degrees C.) and if the sensor is functioning properly its temperature is higher than that critical value. The internal resistance could also be employed as a measure of the operating state. If sensor 14 is not functioning properly, control goes to block 2008 to set $K_2=1$ and exits to block 1006. With the oxygen sensor working properly, control advances to block 2002 to check if the air-fuel ratio as represented by the sensor output is greater than 15% (see FIG. 5). If smaller than 15%, the engine operating demand indicates that the mixture must be enriched and control goes to block 2008 to ignore integral operation. If greater than the 15% value, control exits to block 2003 to detect an optimum current value $i_R$ which corresponds to optimum air-fuel ratio as a function of engine speed value N and airflow rate value Q from a lookup table stored in the ROM as shown in FIG. 10 in which the table is sectioned into different engine load areas I, II, III, IV and V. The actual current value i of sensor 14 is detected (block 2004) and the deviation of the actual air-fuel ratio represented by i from the optimum air-fuel ratio represented by $i_R$ is detected (block 2005) to derive an integral trimming value $\Delta K_2$ as a function of the deviation i in accordance with a nonlinear relationship shown in FIG. 11 (block 2006). This relationship is determined by the desired response and precision requirements in relation to the operating performance of the engine. The relationship of FIG. 11 illustrates that the integral trimming value increases at a higher rate with the increase in the deviation $\Delta i$. This nonlinear relationship is desired to improve quick response characteristic. The integral trimming value is added to the trimming value $K_2$ (block 2007) and control advances to block 1006.

As described above, the air-fuel ratio is feedback controlled at a value that is optimized for varying engine operating conditions.

As a function of the operating time the relationship between saturation current $i_R$ and air-fuel ratio tends to differ from the true relationship which has been established at the time of calibration and the operating curve of FIG. 5 does no longer apply. It has been shown that this problem manifests as a change in the slope ratio or angle "a" of the operating curve of FIG. 5, or as a shift of its point of origin, or as a combination of both.

Figure 12:
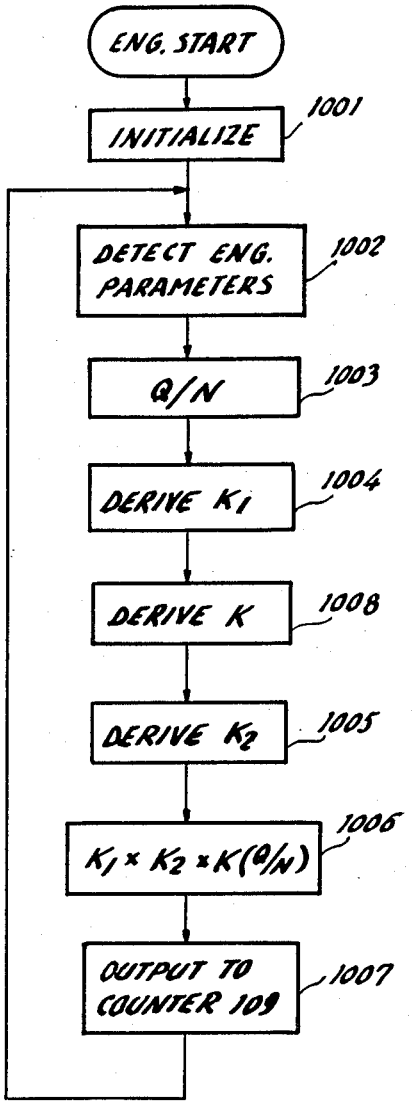
FIGS. 12 to 14 are flow diagrams of a second embodiment of the present invention.
Figure 13:
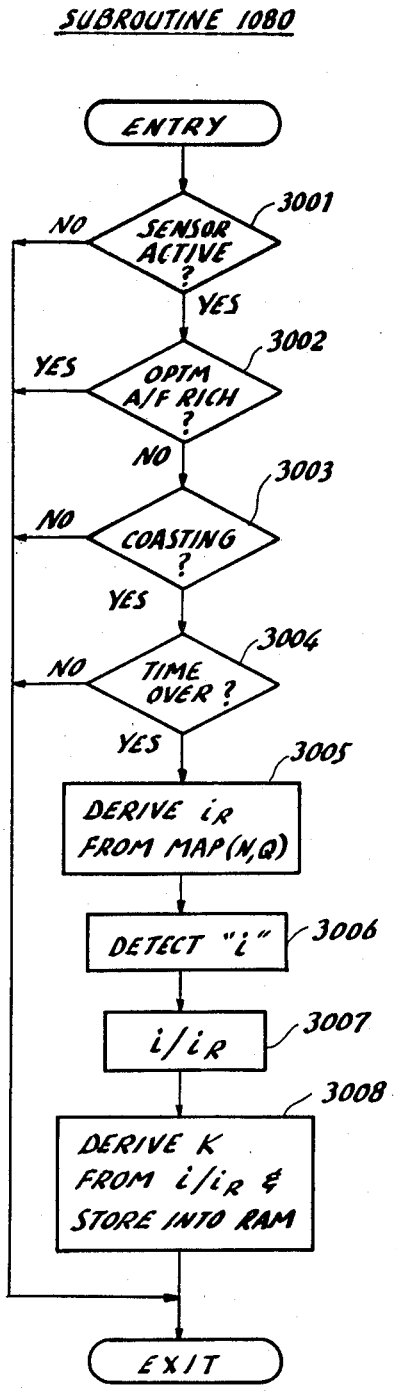
Figure 14:
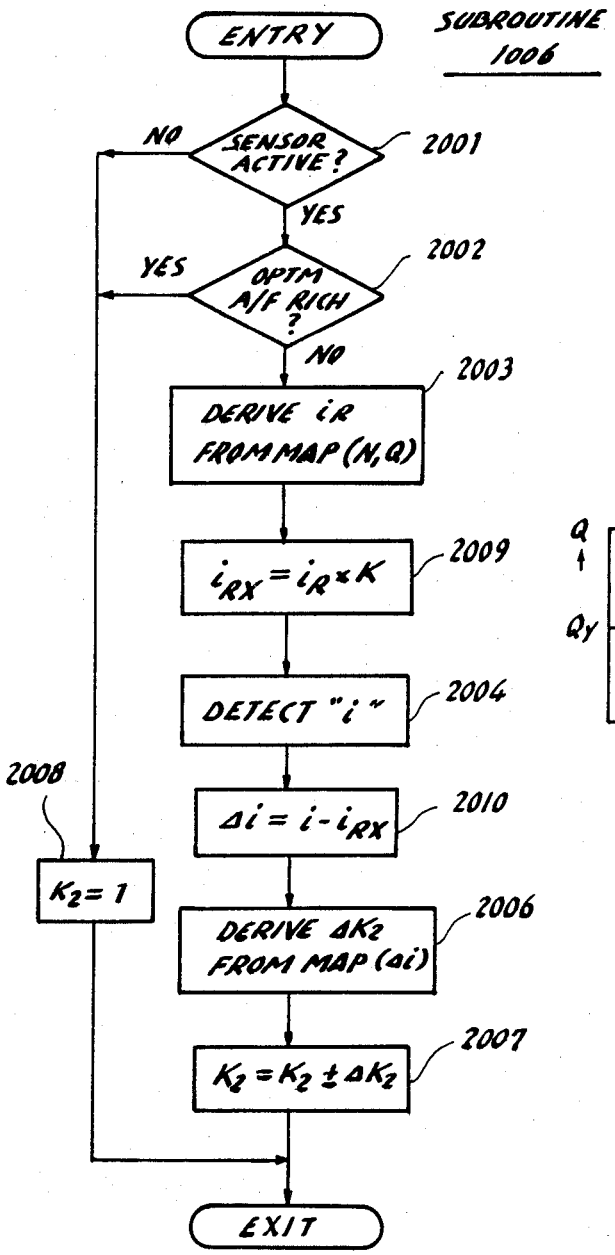

FIGS. 12 to 14 are illustrations of flow diagrams according to a second embodiment of the present invention which is useful for eliminating the type of problem which manifests itself as a change in the slope ratio. The flow diagram shown in FIG. 12 is generally similar to that of FIG. 8 with the exception of a block 1008 which is added to derive an additional trimming value K for correcting the saturation current $i_R$ just prior to the derivation of a trimming value $K_2$ in block 1005. The flow diagram shown in FIG. 13 illustrates a subroutine in which the trimming value K is derived.

Figure 15:
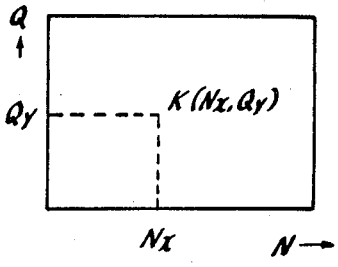
FIG. 15 is an illustration of a lookup table in which aging-effect trimming values are stored in matrix locations.

In FIG. 13, the CPU 100 executes the instructions stated in blocks 3001 and 3002 which are similar to blocks 2001 and 2002 and terminates the subroutine if the sensor is not active and the air-fuel ratio is enriched. If the sensor is active and the air-fuel ratio is lean, control proceeds to block 3003 to check to see if the vehicle is coasting and if not, control terminates the subroutine. If coasting, timing action is provided (block 3004) to check whether the coasting drive has continued for a predetermined amount of time. Control now advances to block 3005 to derive an optimum current value $i_R$ from a lookup table as shown in FIG. 10 as a function of engine speed N and airflow rate Q. The oxygen sensor current i is measured (block 3006) and divided by $i_R$ (block 3007) to derive a ratio $i/i_R$. Since the measurement of sensor current i is effected during coasting drive, the measured value can be treated as one which generally corresponds to the desired air-fuel ratio and its deviation from $i_R$ and hence the ratio $i/i_R$ can be regarded as an indication of a aging-attributed false condition of oxygen sensor 14. A trimming value K for correction of the aging effect is derived from the ratio $i/i_R$ and stored in a lookup table as shown in FIG. 15 in the RAM 107 which can be addressed as a function of engine speed N and airflow rate Q (block 3008). As a K value, the ratio $i/i_R$ can be used directly or an average value of previously derived ratios may be used.

FIG. 14 is an illustration of the detail of block 1005 which follows the K derivation subroutine. The stated functions in block 1005 are generally similar to those shown in FIG. 9 with the exception of an additional step which is included as block 2009 between steps 2003 and 2004. After the derivation of an optimum current value $i_R$ from the map of FIG. 15 (block 2003), control proceeds to block 2009 to multiply $i_R$ by the K value to derive a corrected $i_{Rx}$. This corrected optimum value $i_{Rx}$ is used in block 2010 to detect the deviation of actual sensor current i from the corrected optimum value. The air-fuel ratio is controlled with immunity to the discrepancies between air-fuel ratio and saturation current.

In a practical embodiment, a plurality of trimming values K are derived as a function of various operating parameters including engine speed and airflow rate and the derived K values are weighted and averaged. This serves to minimize variations in the K value between different engine operating conditions and stabilizes the feedback control against varying engine conditions.

The aging problem which manifests itself as a shift in the point of origin of the saturation current curve as well as a change in the slope ratio can be eliminated by operating the switch SW to disconnect the bias potential from the oxygen sensor 16 to control the air-fuel ratio in response to the output voltage directly obtained from the oxygen sensor 14. Since this sensor voltage has a sharp transition at stoichiometry (when air-fuel ratio is approximately 15), the mixture ratio is controlled to stoichimetry. With the air-fuel ratio being controlled to stoichiometry, the bias potential is reapplied to switch the air-fuel control mode to lean operation and register a saturation current which represents an offset value io, i.e., the amount of deviation from the true optimum value. The system is then switched to an open loop mode and the air-fuel mixture is forcibly set to a point displaced by a predetermined value $\Delta(A/F)$ on the leaner side of stoichiometry and a saturation current $i_1$ is registered. Assume that the aging effect has resulted in an operating curve having an angle "b" greater than angle "a", the new angle value "b" can be estimated by an equation $(i_1-io)/\Delta(A/F)$. The aging-affected relationship between air-fuel ratio and saturation current is represented by $(b/a)i_R+io$. The aging effect is eliminated by correcting the optimum saturation current $i_R$ with trimming values K' and K'' (where $K'=b/a$, $K''=io$).

FIG. 16 to 19 are illustrations of a third embodiment of the invention which eliminates the aging problem just mentioned.

Figure 16:
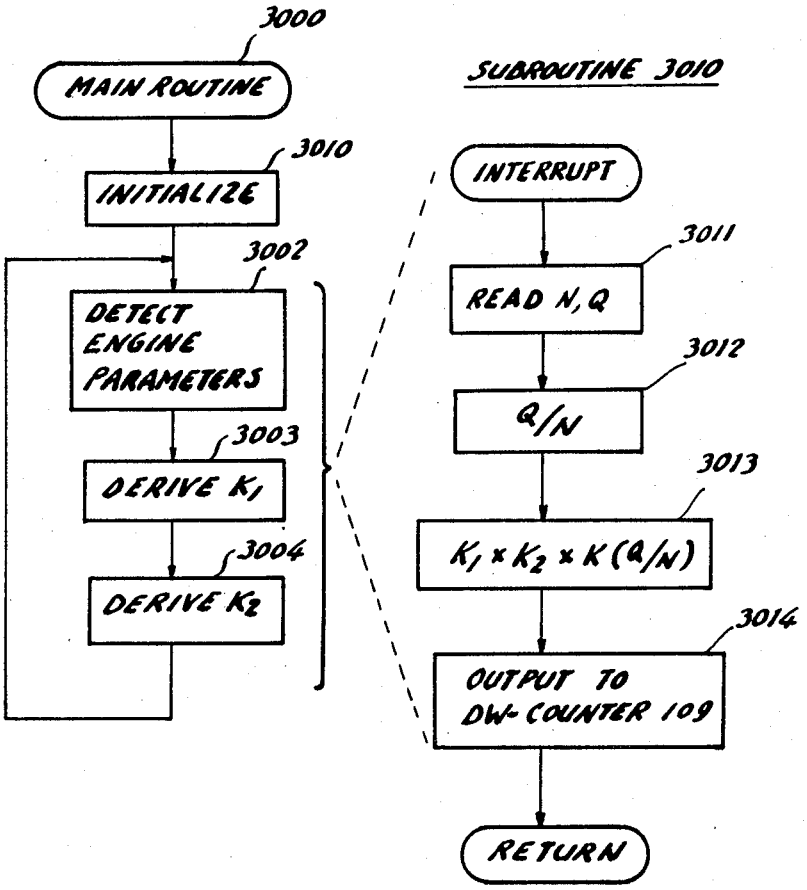
FIGS. 16–19 are flow diagrams of a third embodiment of the present invention.

In FIG. 16 which shows a main routine of the microprocessor 100, various engine operating parameters are detected (block 3002), and trimming values $K_1$ and $K_2$ are derived (blocks 3003 and 3004). Blocks 3002 to 3004 are repeated in this main routine. The main routine is interrupted in response to a predetermined crankshaft angle to execute a subroutine 3010. Engine speed parameter N and airflow parameter Q are read (block 3011) and used in block 3012 to derive a basic fuel quantity Q/N. Control proceeds to block 3013 to compute $K_1 \times K_2 \times K(Q/N)$ to derive a trimmed fuel quantity which is delivered to down-counter 109 (block 3014), terminating the subroutine (block 3015). The aging compensating trimming value K may be derived from the values K' and K'' mentioned above.

Figure 17:
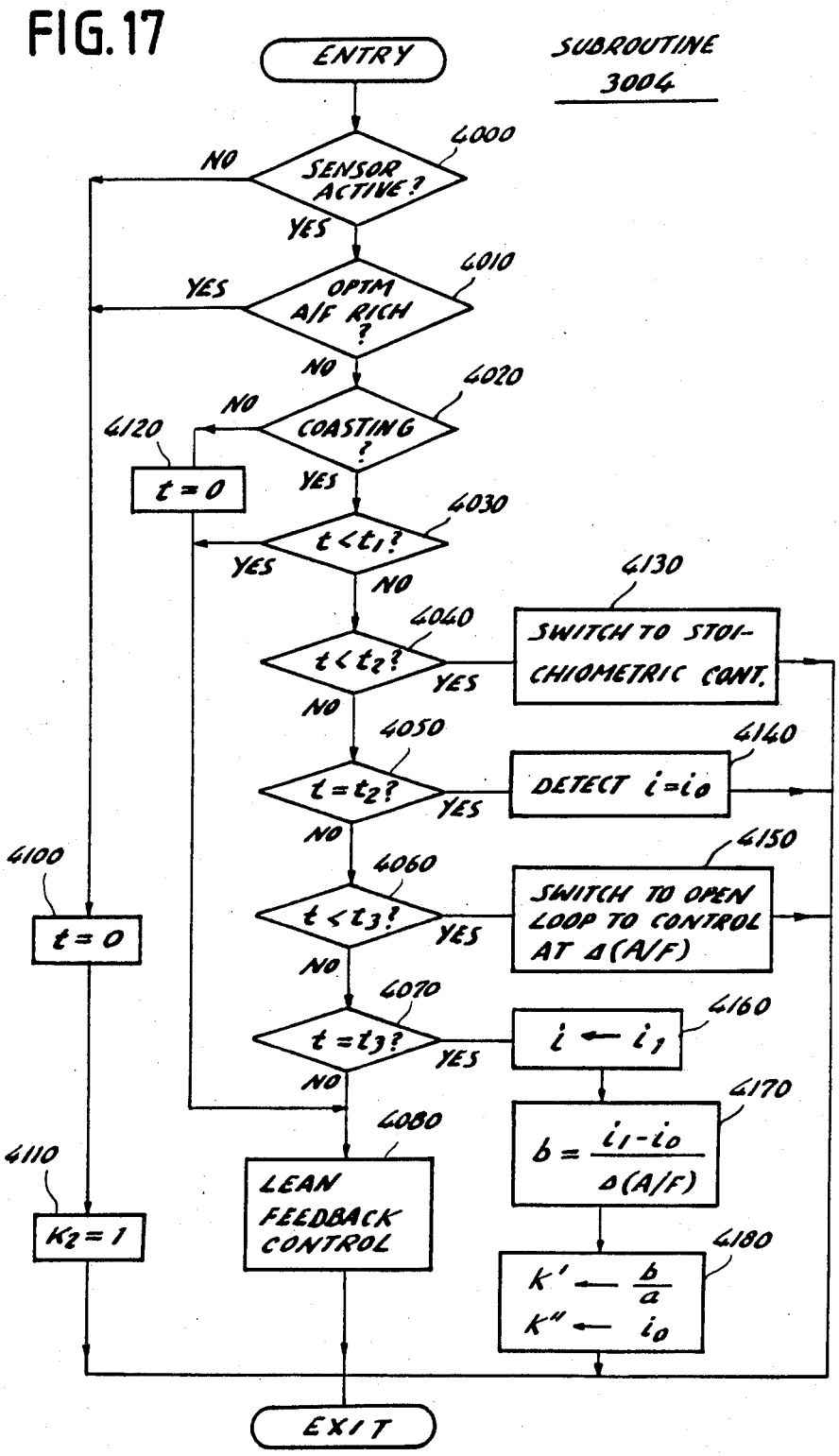

Details of the block 3004 of the main routine are illustrated in FIG. 17. The operating status of oxygen sensor 14 is checked (block 4000). Control goes to blocks 4100 and 4110 if the sensor is not active and sets a coasting drive timer t to 0 and trimming value $K_2$ to 1. Active state of the sensor 14 causes control to proceed to block 4010 to check whether the mixture is rich or lean. This is accomplished by addressing the lookup table of FIG. 10 as a function of engine speed and airflow rate and checking the addressed air-fuel ratio against the stoichiometric value. Since feedback operation is not possible on the rich side of stoichiometry due to the absence of a linear characteristic, control goes to step 4100 if rich mixture is detected in step 4010. If a lean mixture is detected in step 4010, control steps to block 4020 to detect coasting drive (in which the engine rpm is 2000 to 3000 and the absolute value inducted air quantity is 1/10 to $\frac{1}{8}$ of full engine load, and the variations of these values are sufficiently small to derive a steady output from oxygen sensor 14) to utilize the linear operating characteristic of the sensor 14 in the following steps to compensate for the aging effects. If coasting drive is not detected, block 4120 is executed to set coasting timer t to 0 and effect lean feedback operation (block 4080). If coasting drive is detected, block 4030 is executed to check if t is smaller than $t_1$ which equals a period of a few seconds. If the coasting drive condition exists for a period smaller than $t_1$, air-fuel ratio is fluctuating and the detected condition is dismissed as a false condition and control jumps to block 4080 to effect lean feedback operation. When time period $t_1$ is elapsed, control passes through block 4040 to blcok 4130 to switch the air-fuel control to stoichiometry until $t_2$ (which is greater than $t_1$ by a few seconds) is elapsed.

Figure 18:
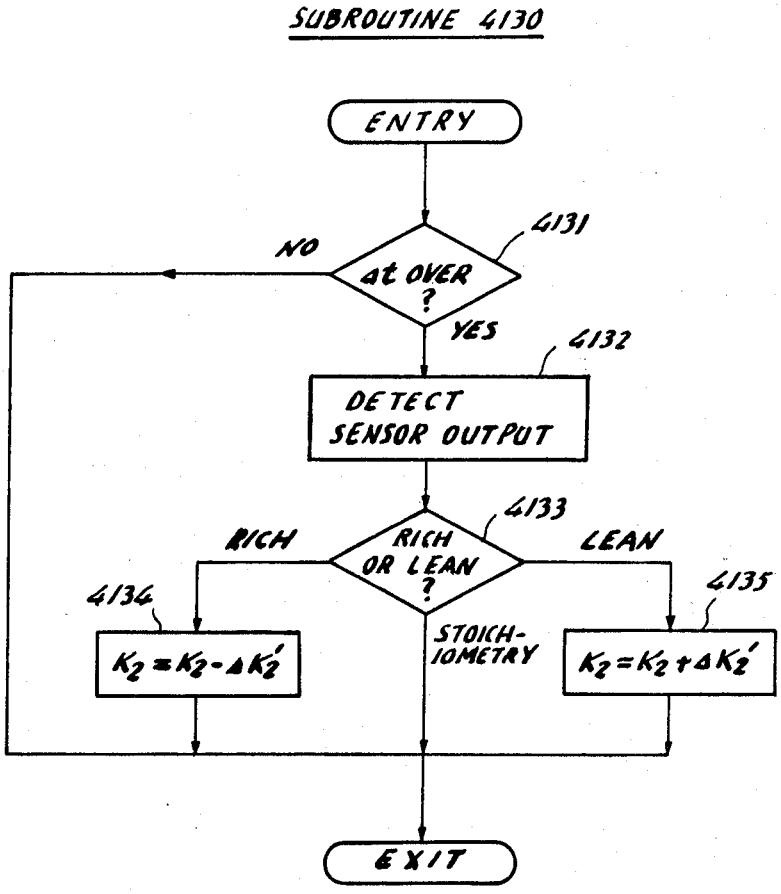

Details of the block 4130 are shown in FIG. 18. With the elapse of a predetermined brief period (block 4131), control advances to block 4132 to switch the mode select switch SW to the stoichiometric control position to remove the bias potential from the oxygen sensor 14 to allow it to exhibits its sharp transitory characteristic at stoichiometric point, so that the air-fuel mixture approaches the stoichiometric point. Stoichiometric control is performed by comparing the oxygen sensor output with a predetermined value representing the stoichiometric value (block 4133). If the air-fuel ratio is at or near stoichiometry, the subroutine 4130 terminates. If rich mixture is detected, the trimming value $K_2$ is decremented by $\Delta K_2$ (block 4134) and if lean mixture is detected, the trimming value is incremented by the same amount (block 4135). This mixture control is continued for a period $t_2$ (block 4040) to allow the engine to be feedback controlled at stoichiometric mixture ratio. Program control passes through block 4050 to block 4140 to switch the mode select switch SW back to the lean control position to reapply the bias potential to the oxygen sensor 14 to register the saturation current. The amount of this saturation current corresponds to that which is generated when the air-fuel ratio is at or near stoichiometry and thus represents the offset current mentioned above.

Control then passes through block 4060 to block 4150, the feedback control is disabled and air-fuel ratio is set to a fixed value displaced by a predetermined amount $\Delta(A/F)$ on the leaner side of stoichiometry. A typical value of this air-fuel ratio is 18. This open loop lean-controlled operation is continued for a period $t_3$ (block 4060). At time $t_3$ control passes through block 4070 to block 4160 to register a saturation current $i_1$, which represents the value obtained during the lean mixture control. The angle "b" of the saturation current curve is determined in block 4170 by calculating $(i_1-i_o)/\Delta(A/F)$. Trimming value K' is set equal to the ratio b/a and trimming value K" is set equal to the offset current value io (block 4180), these trimming values being stored into the backup RAM.

With time $t>t_3$, control passes straight through decision blocks 4000 to 4070 to block 4080 to resume the lean feedback operation.

Figure 19:
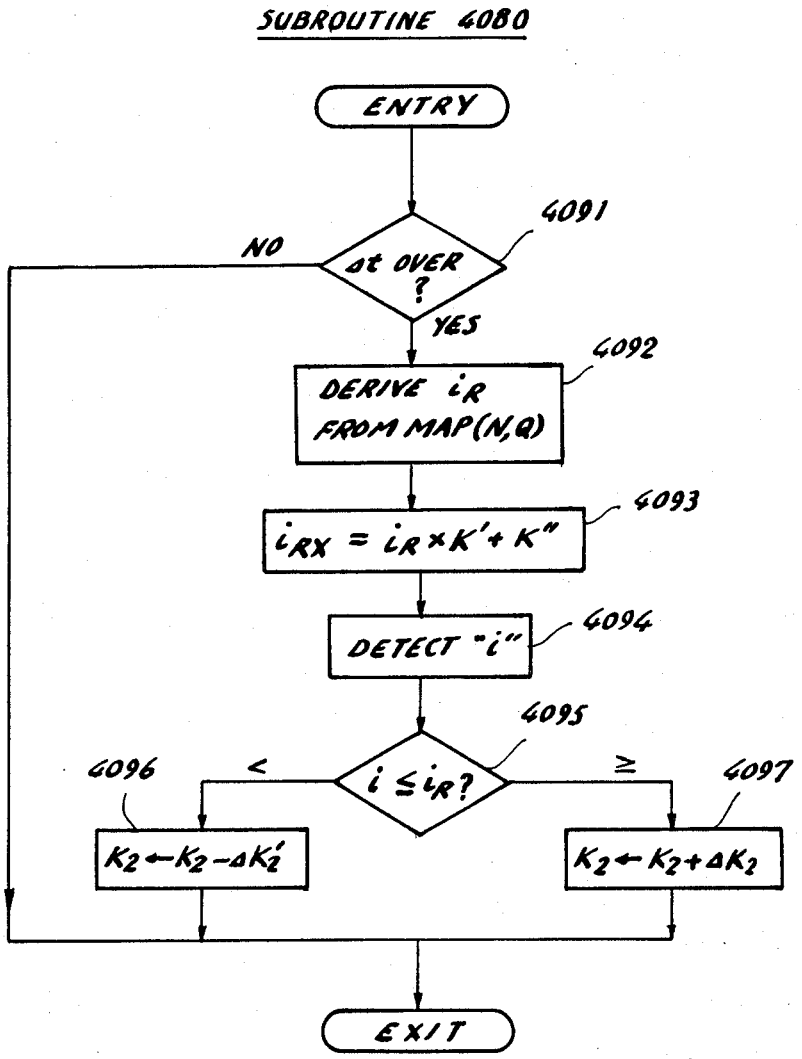

Details of the operation of block 4080 are illustrated in FIG. 19. With the elapse of a predetermined brief interval (block 4091), an optimum saturation current $i_R$ is addressed as a function of engine speed and airflow rate from the lookup table, FIG. 10 (block 4092). The addressed current value $i_R$ is multiplied by K' and summed with K" to derive a corrected optimum value $i_{RX}$ (block 4093). The mode select switch SW is turned to the lean feedback mode position to reapply the bias potential to the oxygen sensor 14 and a saturation current i is detected (block 4094). The corrected optimum value $i_RX$ is used as a reference with which the detected saturation currrent is compared (block 4095). If $i<i_{RX}$, the deviation trimming value $K_2$ is decremented by a predetermined value $\Delta K_2'$ (block 4096), and if $i>i_{RX}$, $K_2$ is incremented by $\Delta K_2'$ (block 4097).

In the illustrated embodiment, the same trimming values K' and K" are used for different engine operating parameters. In a preferred embodiment, the trimming values K' and K" may be modified in accordance with previously obtained data by performing weighting and/or averaging operations thereupon.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A mixture control system for an internal combustion engine, comprising:

oxygen detecting means, biased at a predetermined potential, for generating a sensor signal which varies linearly as a function of the oxygen concentration of exhuast emissions from said engine when the air-fuel ratio of mixture supplied thereto is leaner than stoichiometric value;

engine parameter detecting means for detecting engine operating parameters;

memory means for storing a plurality of optimum values of said signal in storage locations addressable as a function of said detected engine operating parameters; and processing means for determining the quantity of fuel to be supplied to said engine in accordance with said detected engine operating parameters, for addressing said memory means as a function of said detected engine operating parameters to derive one of said optimum values, for detecting a difference between said generated sensor signal and said one of optimum values derived from said memory means, and for integrating said difference and correcting the fuel quantity with the integrated value.

2. A mixture control system for an internal combustion engine comprising:

oxygen detecting means for generating a signal which varies linearly as a function of the oxygen concentration of exhaust emissions from said engine when the air-fuel ratio of mixture supplied thereto is leaner than stoichiometric value;

engine parameter detecting means for detecting engine operating parameters;

memory means for storing optimum values of said signal in storage locations addressable as a function of the detected engine operating parameters; and processing means for determining the quantity of fuel to be supplied to said engine in accordance with the detected engine operating parameters, addressing said memory means as a function of the detected engine operating parameters, detecting a signal from said sensor means during a steady engine operating condition, detecting a first deviation of the detected sensor signal from a signal addressed in said memory means and deriving therefrom a first trimming value, correcting the addressed signal in accordance with said first trimming value, detecting a second deviation of the detected sensor signal from the corrected signal, deriving a second trimming value from said second deviation, and correcting the fuel quantity in accordance with said second trimming value.

3. A mixture control system as claimed in claim 2, wherein said first deviation represents a ratio of the signal from said sensor means to the signal from said memory means.

4. A mixture control system for an internal combustion engine comprising:

oxygen detecting means for generating a sensor signal which varies linearly as a function of the oxygen concentration of exhaust emissions from said engine when the air-fuel ratio of mixture supplied thereto is leaner than stoichiometry;

engine parameter detecting means for detecting engine operating parameters;

memory means for storing optimum values of said signal in storage locations addressable as a function of the detected engine operating parameters; and processing means for determining the quantity of fuel to be supplied to said engine in accordance with the detected engine operating parameters, detecting a first sensor current during a first steady engine operating condition, detecting a second sensor signal from said sensor means during a second steady engine operating condition, detecting a deviation of said first sensor signal from said second sensor signal and deriving a first trimming value therefrom, addressing said memory means as a function of the detected engine operating parameters and correcting a signal addressed in said memory means in accordance with said first trimming value, detecting a third sensor signal from said sensor means, detecting a deviation of said third sensor signal from said addressed signal, deriving a second trimming value from said deviation, and correcting the fuel quantity in accordance with the second trimming value.

5. A mixture control system for an internal combustion engine comprising:

oxygen detecting means responsive to a first command for generating a sensor signal which varies sharply at the stoichiometry as a function of said oxygen concentration when said air-fuel ratio is varied between opposite sides of the stoichiometry and responsive to a second command for generating a sensor signal which varies linearly as a function of the oxygen concentration of exhaust emissions from said engine when the air-fuel ratio of mixture supplied thereto is leaner than stoichiometry;

engine parameter detecting means for detecting engine operating parameters;

memory means for storing optimum values of said signal in storage locations addressable as a function of the detected engine operating parameters; and processing means for determining the quantity of fuel to be supplied to said engine in accordance with the detected engine operating parameters, generating said first command during a steady engine operating condition to allow the air-fuel ratio to be controlled to the stoichiometry and detecting a first sensor signal from said sensor means, causing the air-fuel ratio to be controlled to a value displaced on the leaner side the stoichiometry by a predetermined amount during the steady engine operating condition and detecting a second sensor signal from said sensor means, deriving a first trimming value from said first and second sensor signals, addressing said memory means as a function of the detected engine operating parameters and correcting a signal addressed in said memory means in accordance with said first trimming value, generating said second command and detecting a third sensor signal from said sensor means, detecting a deviation of said third sensor signal from said corrected signal, deriving a second trimming value from said deviation, and correcting the fuel quantity in accordance with the second trimming value.

6. A mixture control system as claimed in claim 5, wherein said first trimming value is proportional to the difference between said first and second signals from said sensor means.

7. A mixture control system as claimed in claim 6, wherein said first trimming value is inversely proportional to said predetermined amount of displacement from the stoichiometry.

8. A mixture control system as claimed in claim 7, wherein said first trimming value is variable as a function of said first sensor signal.

9. A mixture control system for an internal combustion engine, comprising:

oxygen detecting means biased at a predetermined potential for generating a sensor signal which varies linearly as a function of the oxygen concentration of exhaust emissions from said engine when the air-fuel ratio of mixture supplied thereto is leaner than stoichiometric value;

engine parameter detecting means for detecting engine operating parameters;

memory means for storing a plurality of optimum values of said signal in storage locations addressable as a function of the detected engine operating parameters; and feedback control means for controlling an air-fuel ratio of mixture supplied to said engine to different ratios, said feedback control means addressing said memory as a function of said detected engine operating parameters to derive one of said optimum values, for detecting a difference between said generated sensor signal and said one of optimum values derived from said memory means, and for correcting the air-fuel ratio of mixture in accordance with the detected difference.

10. A mixture control system for an internal combustion engine, comprising:

means for detecting oxygen concentration in exhaust emissions from said engine and generating a sensor signal varying sharply at the stoichiometric value when no voltage is applied thereto and varying linearly in direct proportion of the oxygen concentration when a voltage is applied thereto;

means for applying the voltage to said oxygen detecting means when an air-fuel ratio of mixture is desired to be controlled to a predetermined value leaner than the stoichiometric value;

means for disabling the application of the voltage to said oxygen detecting means during a steady engine operating condition so that the air-fuel ratio of mixture is controlled to the stoichiometric value;

means for detecting a first and second values of said sensor signal when the application of the voltage to said oxygen detecting means is disabled and enabled, respectively;

means for correcting said second value by said first value so that aging effect of said oxygen detecting means is eliminated; and means for controlling the air-fuel ratio of mixture to a predetermined value leaner than the stoichiometric value in accordance with a difference between said corrected second value and a reference value corresponding to the predetermined value leaner than the stoichiometric condition.

* * * * *